US005829140A

United States Patent [19]

Dolev

[11] Patent Number: 5,829,140

[45] Date of Patent: Nov. 3, 1998

[54] ELECTRIC SHAVER

[76] Inventor: Moshe Dolev, 17 Bereshit Street, Ramat Hasharon 47201, Israel

[21] Appl. No.: 804,736

[22] Filed: Feb. 21, 1997

[51] Int. Cl.[6] ..... B26B 19/42

[52] U.S. Cl. ..... 30/41.9; 30/34.2; 30/45

[58] Field of Search ..... 30/34.2, 41.9, 30/42, 43.4, 45

[56] References Cited

U.S. PATENT DOCUMENTS

| | | | |
|---|---|---|---|
| 1,690,133 | 11/1928 | Schick | 30/41.5 |
| 1,918,625 | 7/1933 | Wills | 30/43.2 |
| 2,103,753 | 12/1937 | Muros | 30/41.9 |
| 2,824,367 | 2/1958 | McWilliams | 30/34.2 |
| 2,827,692 | 3/1958 | Wowchuk | 30/41.9 |
| 2,837,819 | 6/1958 | Bauerle | 30/41.9 |
| 2,935,788 | 5/1960 | Kleinman | 30/34.2 |
| 3,065,541 | 11/1962 | Bauerle | 30/41.9 |
| 3,344,517 | 10/1967 | Crane | 30/41.9 |
| 3,413,719 | 12/1968 | Moser et al. | 30/43.2 |
| 3,611,567 | 10/1971 | Crane | 30/41.9 |
| 3,802,072 | 4/1974 | Wintercorn | 30/43.4 |
| 3,879,845 | 4/1975 | Hansom et al. | 30/45 |
| 4,490,907 | 1/1985 | Bendictus | 30/34.2 |
| 4,847,995 | 7/1989 | Savenije | 30/34.2 |
| 5,251,375 | 10/1993 | Crucq et al. | 30/42 |

FOREIGN PATENT DOCUMENTS

| | | | |
|---|---|---|---|
| 121609 | 12/1918 | United Kingdom | 30/42 |

*Primary Examiner*—Hwei-Siu Payer
*Attorney, Agent, or Firm*—Michael N. Meller

[57] ABSTRACT

An electric shaver including an electric motor and a shaving head, driven by the electric motor, for cutting hair to be shaved, the shaving head including: at least one cutting blade having a cutting edge; at least one cutting plate defining a generally flat surface, which the cutting edge engages upon cutting through a strand of hair.

26 Claims, 10 Drawing Sheets

ELECTRIC SHAVER

FIELD OF THE INVENTION

The present invention relates to shavers generally and more particularly to electrically powered shavers.

BACKGROUND OF THE INVENTION

A great variety of electric shavers are known in the patent literature. Many of these shavers remove hair by shearing, which also produces undesired roughening of the user's skin. Examples of this kind of shaver appear in U.S. Pat. Nos. 3,413,719 & 3,879,845.

Another type of electric shaver appearing in the patent literature employs a pair of blades which cut through hair from opposite sides until the blades meet. Although this structure avoids the disadvantages of shearing, it is not practical inasmuch as meeting of blades causes accelerated dulling or misalignment thereof, such that efficient hair cutting can no longer be achieved. Examples of this kind of shaver appear in the following U.S. Pat. Nos.: 1,690,133; 1,918,625; 2,103,753; 2,827,692; 2,837,819; 3,065,541; 3,344,517; 3,611,567 & 3,879,845.

Generally, electric shavers are provided with a protective screen which separates the cutting implements from the user's skin, so as to avoid cutting of the skin. The protective screen includes a multiplicity of apertures through which hair extends. Shearing elements working against the screen engage the hair and sever the hair by shearing against the edges of the apertures. To the extent that skin also extends through the screen apertures, the skin is also sheared and thus roughened. The screens are ineffective to permit hair beyond a certain length to be efficiently severed and also limit the closeness of the shave that can be realized.

SUMMARY OF THE INVENTION

The present invention seeks to provide an improved electric shaver which overcomes disadvantages and limitations of the prior art.

There is thus provided in accordance with a preferred embodiment of the present invention an electric shaver including an electric motor and a shaving head, driven by the electric motor, for cutting hair to be shaved, the shaving head including:

at least one cutting blade;

at least one cutting plate defining a generally flat cutting surface, which the cutting blade engages upon cutting through a strand of hair.

In accordance with a preferred embodiment of the present invention, a pair of cutting blades engage oppositely directed cutting surfaces on each cutting plate.

Further in accordance with a preferred embodiment of the present invention, skin tensioning elements are provided for tensioning a portion of skin bearing a strand of hair to be shaved.

It is a particular feature of the present invention that a protective screen is not required, thus enabling a relatively closer shave to be achieved without cutting of the user's skin.

BRIEF DESCRIPTION OF THE DRAWINGS

The present invention will be understood and appreciated more fully from the following detailed description, taken in conjunction with the drawings in which.

DETAILED DESCRIPTION OF A PREFERRED EMBODIMENT

Figure 2A:
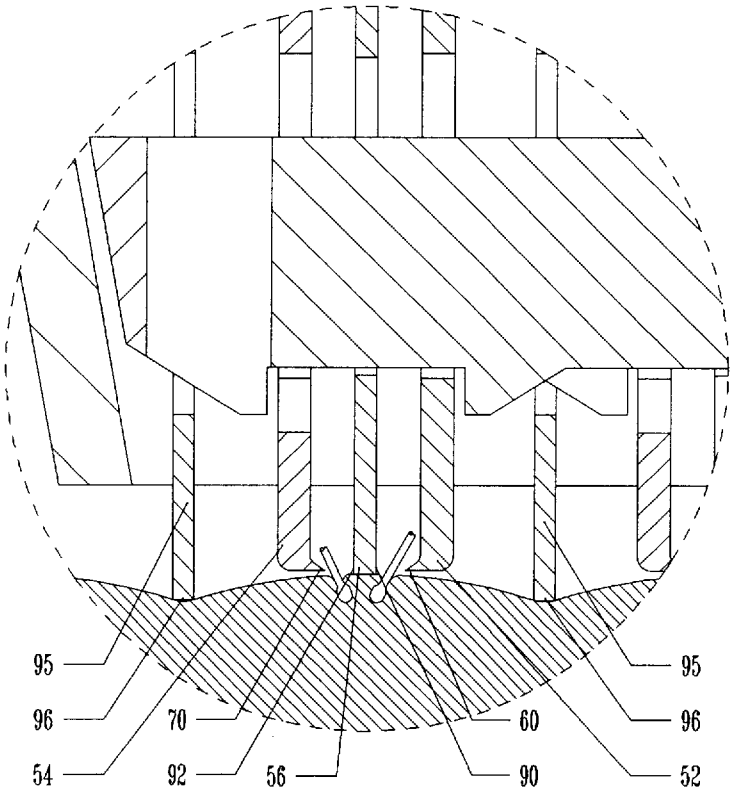
FIGS. 2A and 2B are sectional illustrations of a portion of the shaver of FIGS. 1A and 1B in respective pre-cutting and post-cutting hair engagement.

Reference is now made to FIGS. 1A–8 which illustrate a shaver constructed and operative in accordance with a preferred embodiment of the present invention. The shaver comprises a housing 10 which may be made of any suitable material and is designed to be held in the hand of a user. Preferably the housing is molded of a plastic material integrally with a plurality of internal structural elements, designated by reference numerals 12, 14 and 16, which serve to retain various elements of the shaver in place, as will be described hereinbelow.

Disposed inside housing 10 is an electric motor 18, which may be powered either by an external power source (not shown) or alternatively by batteries 20. Motor 18 and batteries 20 may be retained in place in suitable sockets defined by internal elements 12 and 14. Motor 18 defines an output shaft 22 which is fitted with a gear 23, which preferably engages a reducing gear 24. Reducing gear 24 is attached to a drive shaft 26, preferably fitted with an cam drive head 28 which drivingly engages a shaving head 30.

Referring now particularly to FIGS. 4A–6B, it is seen that shaving head 30 comprises inner and an outer relatively linearly displaceable elongate drive elements 32 and 34. Relative displacement of the drive elements 32 and 34 is produced by rotation of cam drive head 28 in a space defined therebetween.

Inner elongate drive element 32 comprises a generally rectangular shaft 35 having a series of spaced protrusions 36 formed on a surface 38 thereof, while outer elongate drive element 34 comprises a pair of side members 39 located on both sides of rectangular shaft 35 and having a series of spaced protrusions 40 formed on surfaces 42 thereof. Protrusions 40 on both of side members 39 are aligned with each other and are spaced from protrusions 36 on shaft 35 by a variable amount determined by the rotational position of cam drive head 28 in engagement with the shaving head.

Each set of adjacent protrusions 36 and 40 is preferably formed with an upstanding engagement surface, the engagement surfaces being respectively designated by reference numerals 44 and 46.

Figures 4A, 5A, 6A:
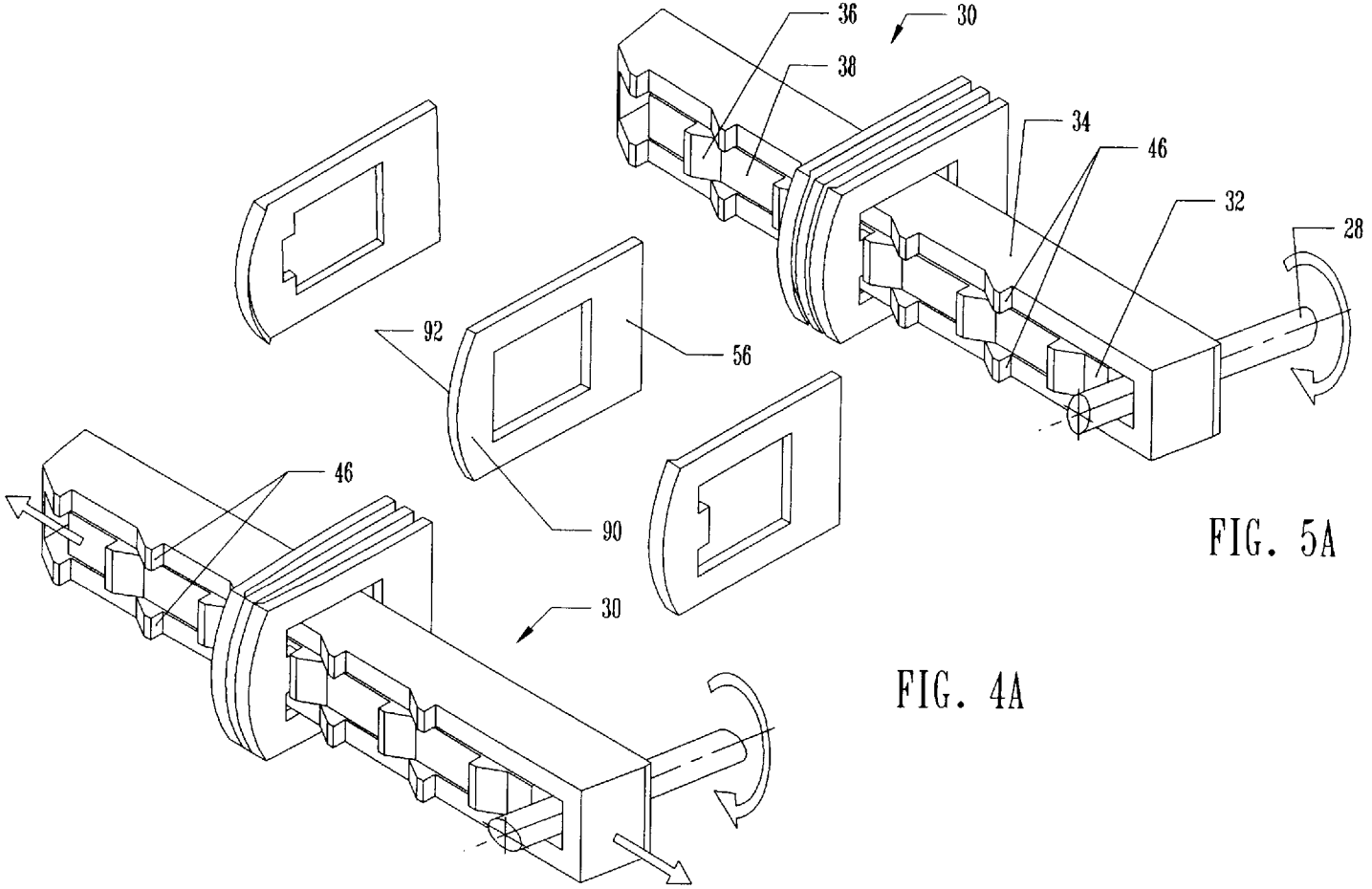
FIGS. 4A and 4B are pictorial exploded view illustrations of a cutting assembly constructed and operative in accordance with a preferred embodiment of the present invention, viewed from two different directions.
FIGS. 5A and 5B are pictorial illustrations of a cutting head constructed and operative in accordance with a preferred embodiment of the present invention, and including a cutting assembly of the type shown in FIGS. 4A and 4B in an open orientation viewed from two different directions.
FIGS. 6A and 6B are pictorial illustrations of the cutting head of FIGS. 5A and 5B in a closed orientation viewed from two different directions.
Figures 4B, 5B, 6B:
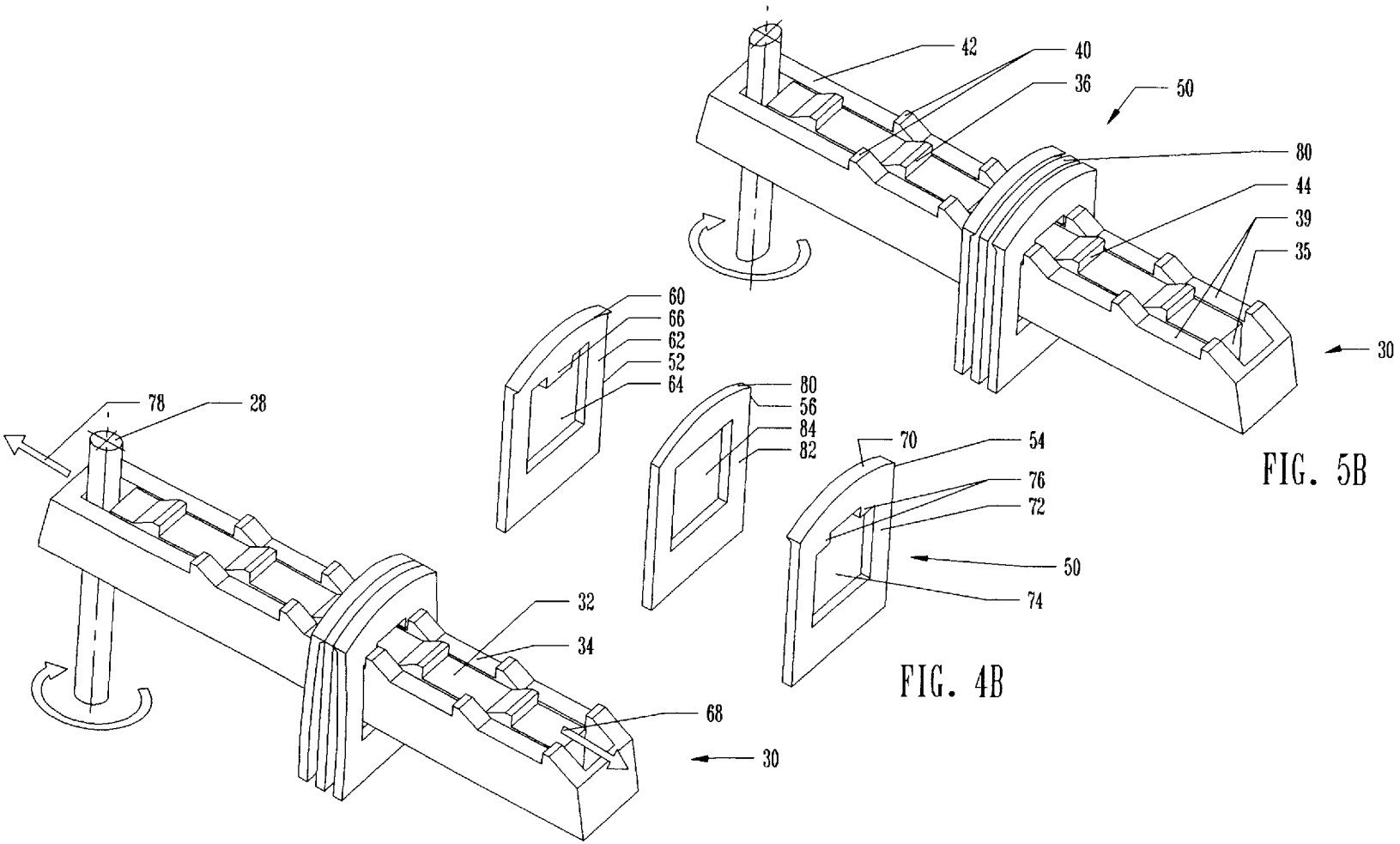
Figure 8:
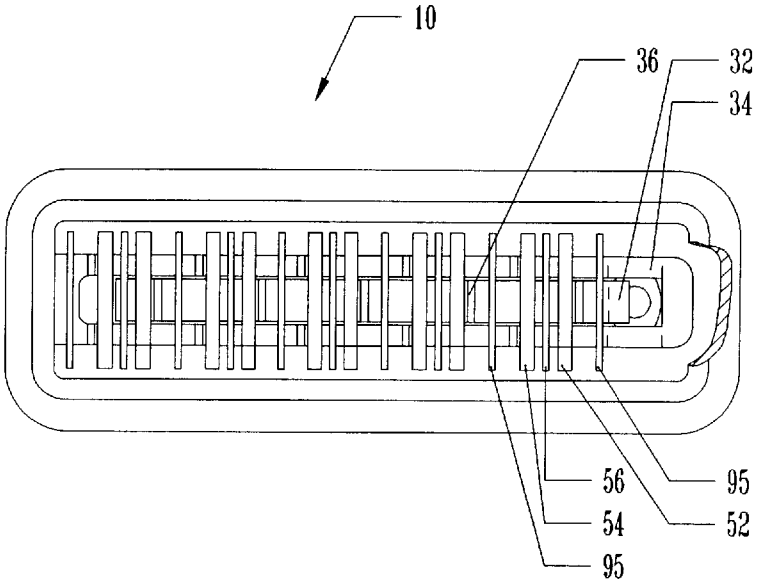
FIG. 8 is a upward facing plan view taken along arrow VIII in FIG. 1A.
Figure 7:
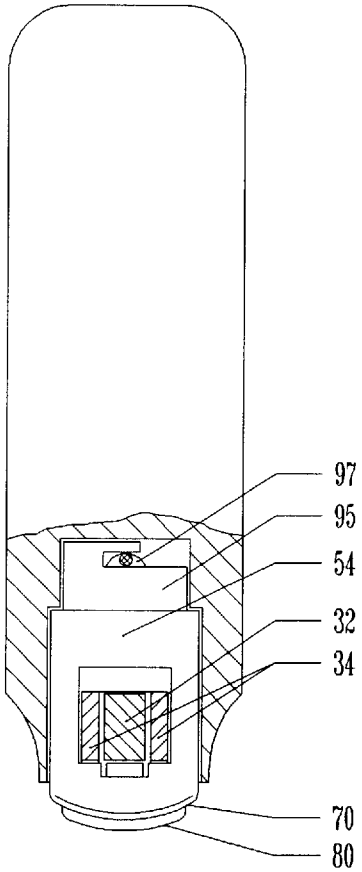
FIG. 7 is a partially cut away side view illustration taken along line VII in FIG. 1A.

In accordance with a preferred embodiment of the present invention disposed between respective upstanding engagement surfaces 44 and 46 is a cutting assembly 50, as shown in FIGS. 4A and 4B. The cutting assembly 50 preferably comprises a first blade 52, a second blade 54 and an cutting plate 56.

First blade 52 preferably comprises a generally curved cutting edge 60 extending generally perpendicularly to a generally rectangular body portion 62 having a central cut-out 64 for accommodating drive elements 32 and 34 therewithin. First blade 52 is preferably formed with a protrusion 66 extending into cut-out 64 adjacent cutting edge 60. Protrusion 66 is configured to be engaged by an engagement surface 44 on driving element 32 for driving of first blade 52 in a direction indicated by an arrow 68.

Second blade 54 preferably comprises a generally curved cutting edge 70 extending generally perpendicularly to a generally rectangular body portion 72 having a central cut-out 74 for accommodating drive elements 32 and 34 therewithin. Second blade 54 is preferably formed with a pair of protrusions 76 extending into cut-out 74 adjacent cutting edge 70. Protrusions 76 are configured to be engaged by engagement surfaces 46 on driving element 34 for driving of second blade 54 in a direction indicated by an arrow 78.

Disposed between first and second blades 52 and 54, cutting plate 56 preferably comprises a generally curved skin engagement edge 80 which preferably extends a short distance beyond cutting edges 60 and 70 of respective first and second blades 52 and 54. (FIG. 3A) This distance, preferably as small as 0.02 mm, is one of the parameters which defines the closeness of the shave which is realized by the shaving head. The closeness of the shave may also be governed by the skin tensioning elements described hereinbelow.

Skin engagement edge 80 extends generally perpendicularly to a generally rectangular body portion 82 having a central cut-out 84 for accommodating drive elements 32 and 34 therewithin. Cutting plate 56 is preferably formed of a material which is somewhat softer than that used to form the first and second blades 52 and 54. Preferred materials for the blades 52 and 54 is hardened stainless steel, up to 60 HRC, and for the cutting plate 56 is soft stainless steel, about 20 HRC. It may be appreciated that the cutting edges 60 and 70 are intended to fully engage respective opposite side surfaces 90 and 92 of the cutting plate 56 at locations between the skin engagement surface 80 and the cut out 84.

Figure 1A:
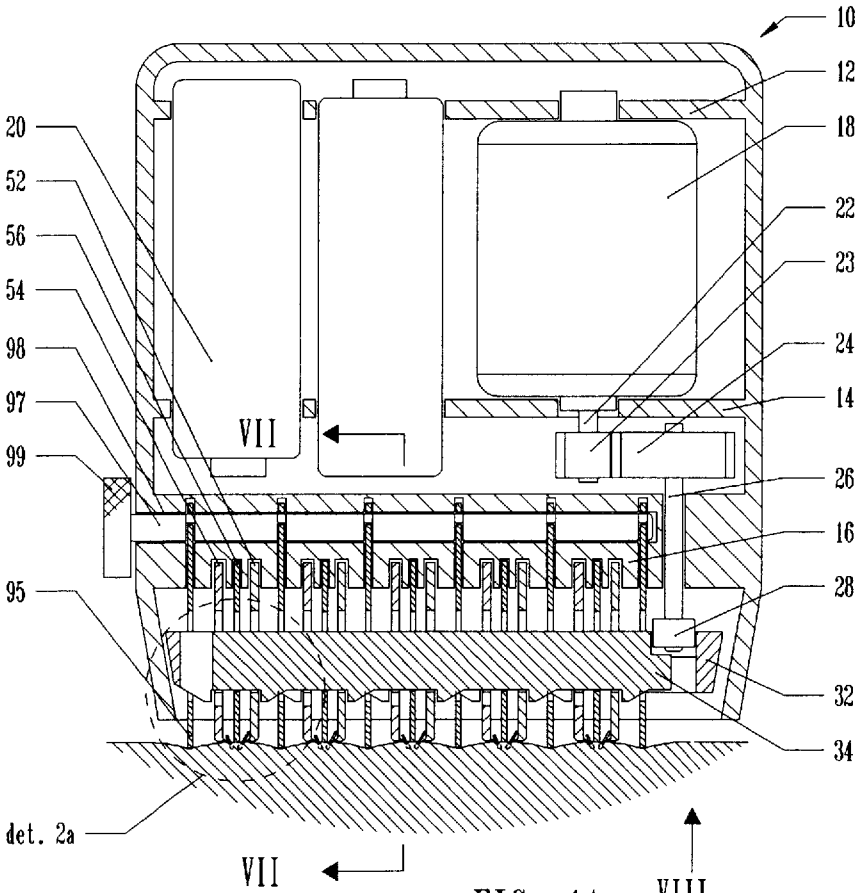
FIGS. 1A and 1B are sectional illustrations of a shaver constructed and operative in accordance with a preferred embodiment of the present invention in respective pre-cutting and post-cutting hair engagement.

Returning to a consideration of FIGS. 1A and 2A, it may be seen that ends of blades 52 and 54 and cutting plate 56 are retained in predetermined spaced relationship in appropriately sized and spaced recesses formed in internal member 16.

It may be appreciated from the foregoing discussion and a consideration of FIGS. 5A–6B, that rotation of the cam driving head 28 in engagement with the drive elements 32 and 34 provides reciprocating cutting action of the blades 52 and 54 against cutting plate 56. The cooperative action of drive elements 32 and 34 serves to urge the cutting edges 60 and 70 of respective blades 52 and 54 towards each other against cutting plate 56 (FIGS. 6A and 6B). The inherent resiliency of the blades 52 and 54 serves to return the blades to their rest positions, separated from cutting plate 56, when the relative orientations of drive elements 32 and 34 permit (FIGS. 5A and 5B).

Figure 10:
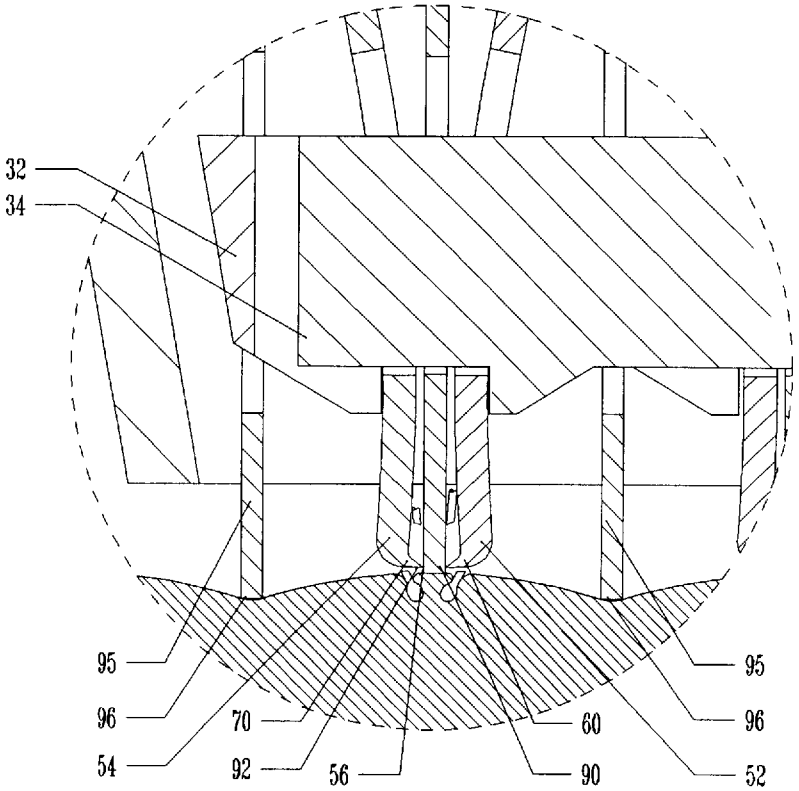
FIG. 10 is an enlargement of a portion of the shaver of FIG. 9.
Figure 9:
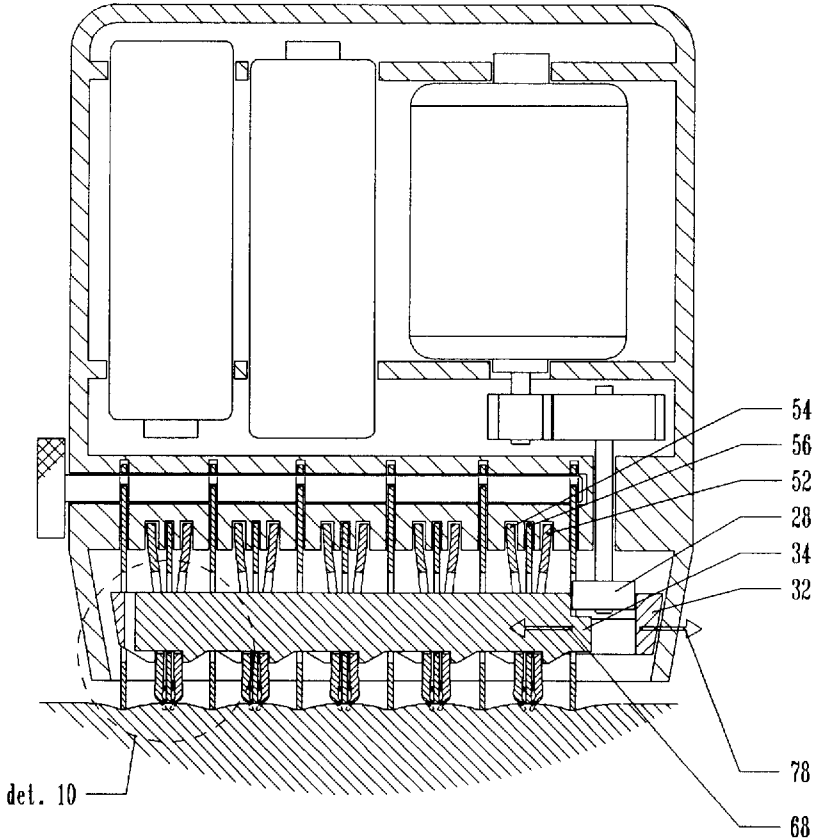
FIG. 9 is a side sectional illustration of the shaver of FIGS. 1A and 1B showing flexing of the cutting blades in an exaggerated manner.

It is a particular feature of the present invention that the reciprocating relative movement of drive elements 32 and 34 has an amplitude which is greater than the amplitude of the displacement of the cutting edges 60 and 70. The difference between the amplitudes is operative to overcome difficulties which would otherwise arise due to variation in manufacturing tolerances and inexactitude in alignment of the blades and in the shaving head as a whole and which could result in incomplete cutting by some of the cutting assemblies. The extra travel of the driving elements 32 and 34 is taken up by the resiliency of the blades 52 and 54, as seen in an exaggerated illustration in FIGS. 9 and 10.

Figure 1B:
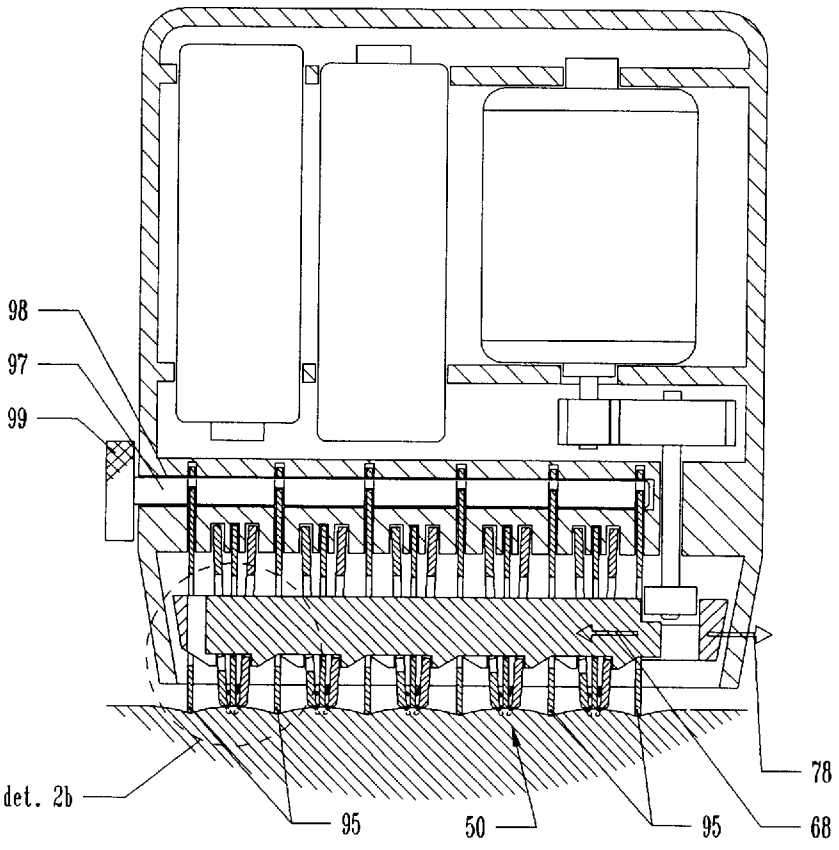

Referring once again to FIGS. 1A–2B it is seen that skin tensioning elements 95 are provided between each cutting assembly 50. The skin tensioning elements preferably are generally flat elements having a curved skin engagement edge surface 96 and a cut-out (not shown) for accommodating drive elements 32 and 34. An end of each skin tensioning element 95 opposite to skin engagement edge surface 96 is mounted on an cam positioning rod 97 located in a corresponding socket 98 in internal element 16 (FIGS. 1A and 1B).

Rod 97 is preferably provided with a control knob 99 which enables a user to select, by rotation of knob 99, the distance by which the skin engagement edge surfaces 96 of elements 95 extend beyond the skin engagement edges 80 of cutting plates 56. Adjustment of this distance enables a user to reduce the closeness of the shave below the maximum closeness defined by the separation between the skin engagement edges 80 and respective cutting edges 60 and 70.

Figure 12:
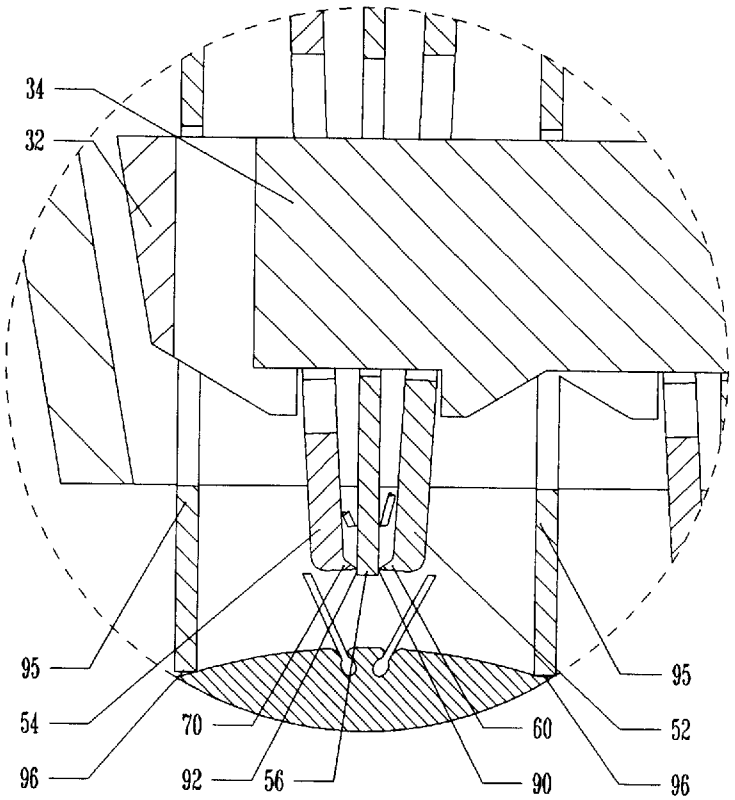
FIG. 12 is an enlargement of a portion of the shaver of FIG. 11, corresponding to FIG. 2A, but showing the provision of a non-close shave.
Figure 11:
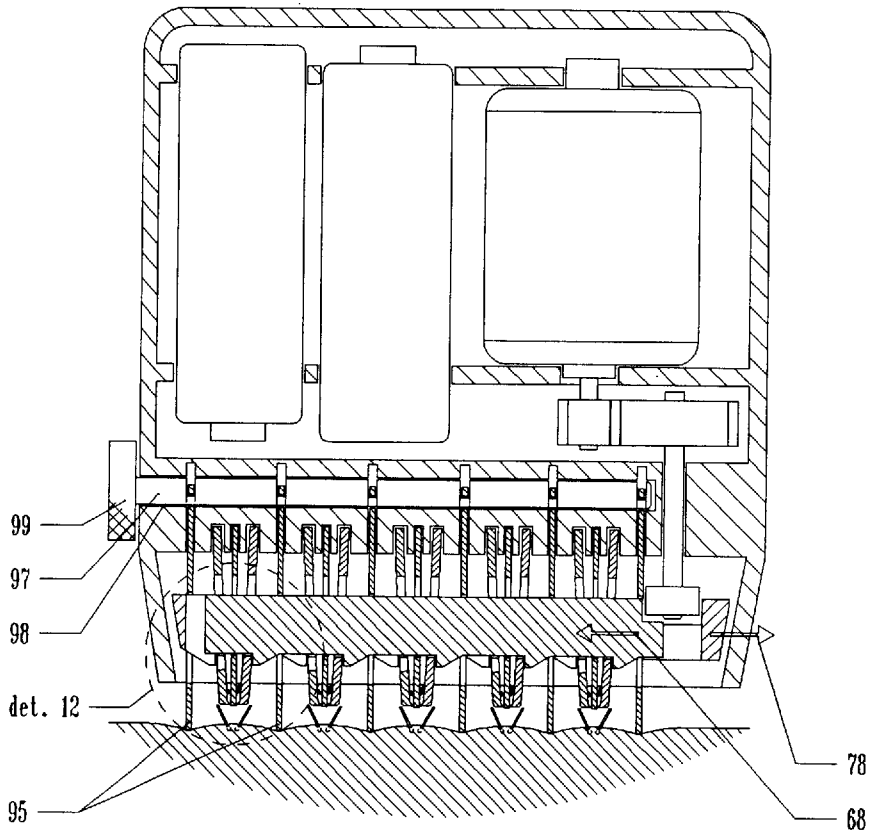
FIG. 11 is a sectional illustration of the shaver of FIG. 1A wherein the skin tensioning are positioned so as to produce a non-close shave.

Positioning of skin engagement edge surfaces 96 for a maximally close shave is illustrated in FIGS. 1A–3C. Positioning of skin engagement edge surfaces 96 for a less than maximally close shave is illustrated in FIGS. 11 and 12.

Operation of the shaver whose structure has been described hereinabove will now be summarized with reference to FIGS. 3A–3C and additional reference to FIGS. 2A and 2B. FIGS. 2A and 3A illustrate an at-rest orientation of the blades 52 and 54 wherein hairs are located between respective cutting edge 60 and 70 and corresponding surfaces 90 of cutting plate 56.

Figure 3A:
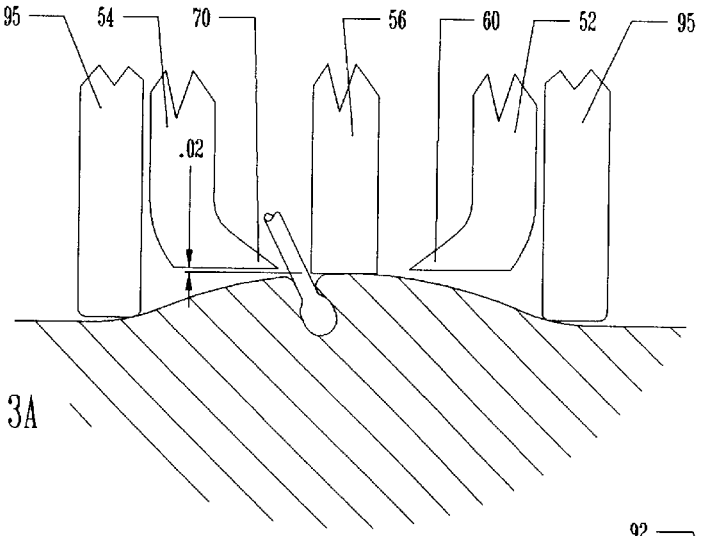
FIGS. 3A, 3B & 3C are schematic illustrations of a portion of the shaver of FIGS. 1A–2B in respective pre-cutting, cutting and post-cutting hair engagement.
Figure 3C:
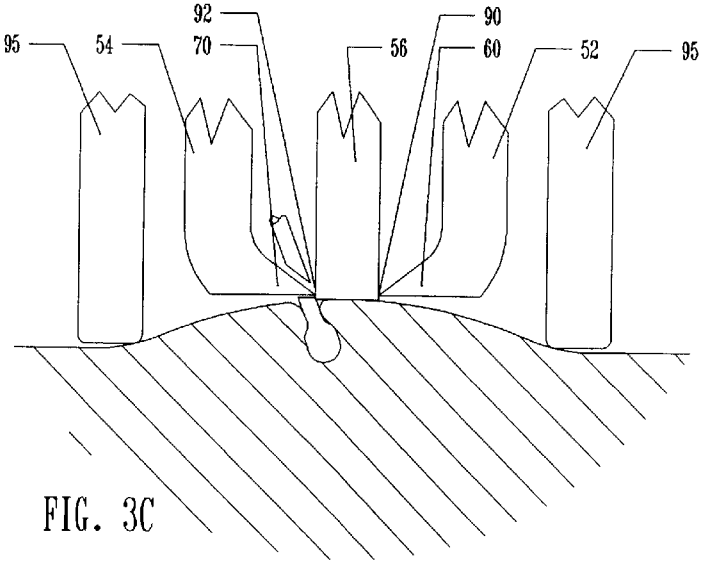
Figure 3B:
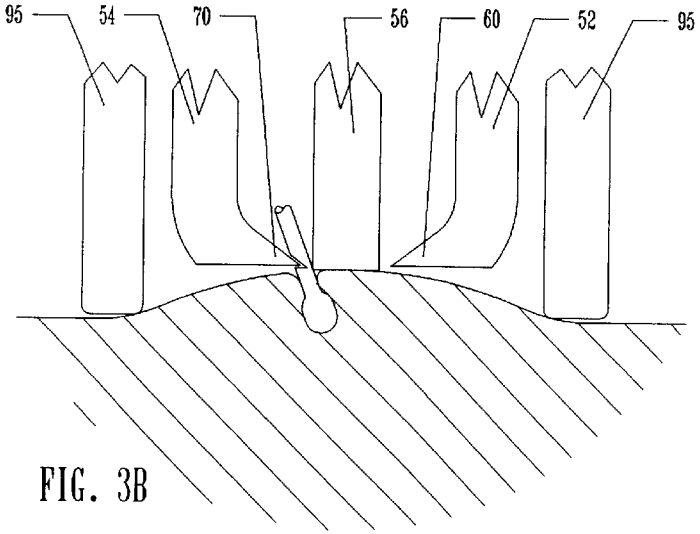

FIG. 3B shows the hair being cut by cutting edge 70. This cutting action is to be distinguished from the prior art shearing action mentioned above and is seen to be such that the blade does not contact the skin principally due to the action of the skin tensioning elements 95.

Figure 2B:
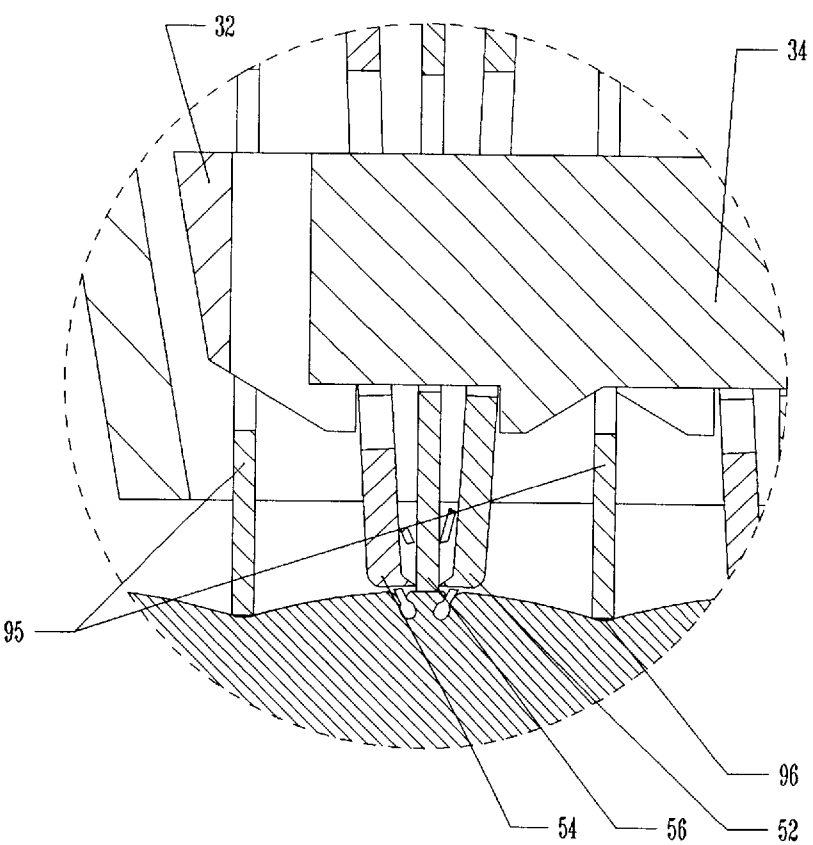

FIGS. 2B and 3C illustrate engagement of the cutting edges 60 and 70 with respective surfaces 90 and 92 of cutting plate 56, in contrast to the prior art situation wherein the cutting edges 60 and 70 engage each other.

It is also a particular feature of the present invention that the skin engagement edge surfaces 96 of elements 95 extend beyond the skin engagement edges 80 of cutting plates 56, thus tensioning the user's skin and making the hair stand up from the skin, as shown in FIGS. 3A–3C. By extending elements 95 even further than that illustrated in FIGS. 3A–3C, the skin engagement edges 80 of cutting plates 56 may be positioned out of contact with the skin, for a less than maximum close shave, as shown in FIGS. 11 and 12. Such a non-close shave is currently fashionable.

Figure 14:
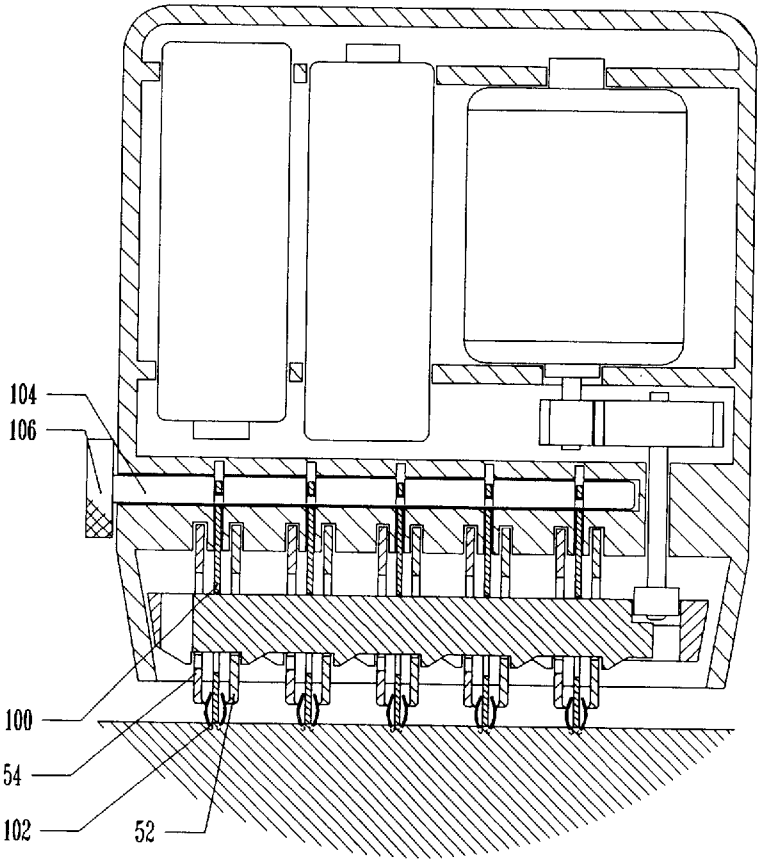
FIGS. 13 and 14 are sectional illustrations of an alternative embodiment of a shaver having variably positionable cutting plates in respective close shave and non-close shave operative orientations.
Figure 13:
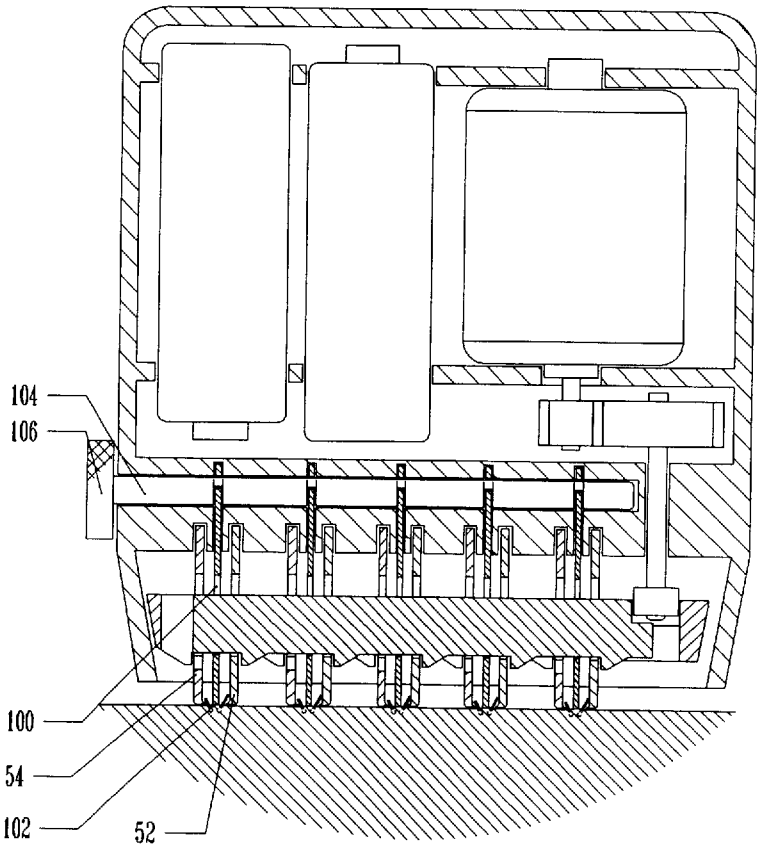

According to an alternative embodiment of the present invention, shown in FIGS. 13 and 14, skin tensioning elements 95 may be eliminated. Instead, selectably positionable cutting plates 100 may be provided. The selectably positionable cutting plates 100 preferably are generally flat elements having a curved skin engagement edge surface 102 and a cut-out (not shown) for accommodating drive elements 32 and 34. An end of each selectably positionable cutting plate 100 opposite to skin engagement edge surface 102 is mounted on an cam positioning rod 104 located in a corresponding socket in internal element 16 (FIGS. 1A and 1B).

Rod 104 is preferably provided with a control knob 106 which enables a user to select, by rotation of knob 106, the distance by which the skin engagement edge surfaces 102 of elements 100 extend beyond the cutting edges of the blades. Adjustment of this distance enables a user to select the closeness of the shave between a very close shave illustrated in FIG. 13 and a relatively non-close shave illustrated in FIG. 14.

Figure 16:
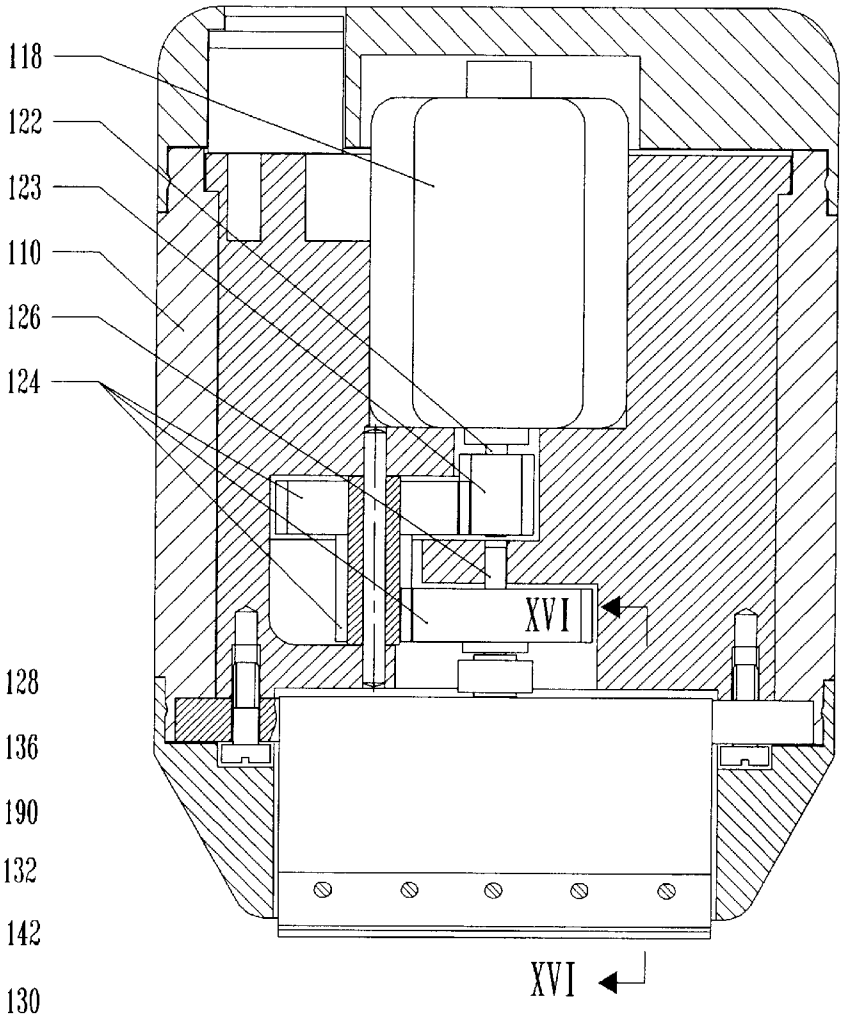
FIG. 16 is a partially cut away sectional illustration of the shaver of FIG. 15, taken along the lines XVI—XVI in FIG. 15.
Figure 15:
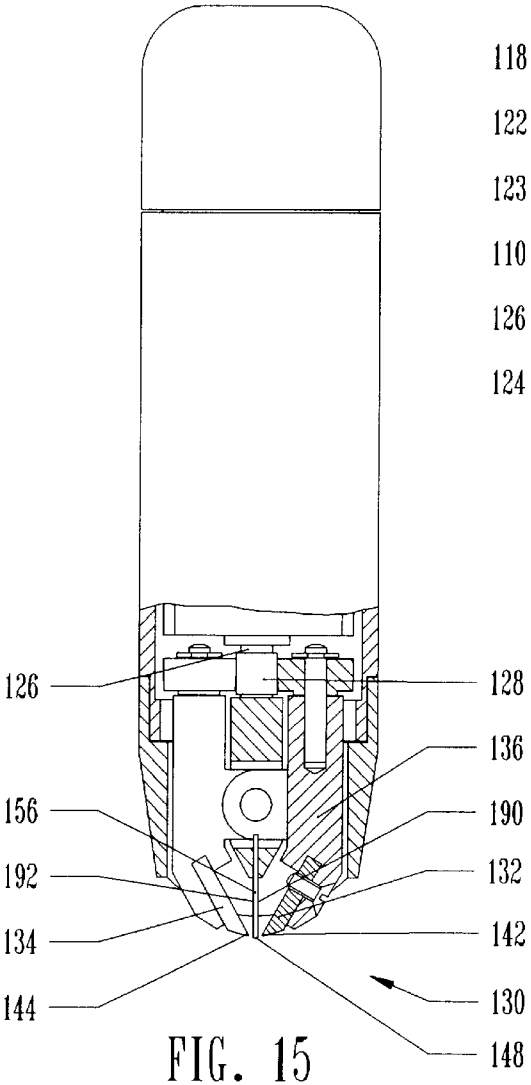
FIG. 15 is a sectional illustration of a shaver constructed and operative in accordance with an alternative embodiment of the present invention.

Reference is now made to FIGS. 15 and 16 which illustrate a shaver constructed and operative in accordance with another preferred embodiment of the present invention. The shaver comprises a housing 110 which may be made of any suitable material and is designed to be held in the hand of a user. Preferably the housing is molded of a plastic material integrally with a plurality of internal structural elements which serve to retain various elements of the shaver in place.

Disposed inside housing 110 is an electric motor 118, which may be powered either by an external power source or alternatively by batteries (not shown). Motor 118 may be retained in place in suitable sockets defined by the internal elements integrally formed with the housing 110. Motor 118 defines an output shaft 122 which is fitted with a gear 123, which preferably engages reducing gears 124. Reducing gears 124 are attached to a drive shaft 126, to which is attached an cam drive head 128, which drivingly engages a shaving head 130.

In the embodiment of the invention illustrated in FIGS. 15 and 16, shaving head 130 comprises first and second elongate blades 132 and 134, which are pivotably mounted with respect to each other by a hinged mounting assembly 136. Relative pivotal displacement of the blades 132 and 134 is produced by rotation of cam drive head 128 in a space defined therebetween.

Each of blades 132 and 134 comprises a cutting edge, respectively indicated as 142 and 144. Driven by the cam driving head 128, the cutting edges 142 and 144 of respective blades 132 and 134 are reciprocally brought into cutting engagement with an cutting plate 156 having a skin engagement edge 148.

Cutting plate 156 is preferably formed of a material which is somewhat softer than that used to form the first and second blades 132 and 134. Preferred materials for the blades is hardened stainless steel, up to 60 HRC, and for the cutting plate is soft stainless steel, about 20 HRC. It may be appreciated that the cutting edges 142 and 144 are intended to fully engage respective opposite side surfaces 190 and 192 of the cutting plate at locations separated from the skin engagement edge 148 by a distance which defines the closeness of the shave.

It will be appreciated by persons skilled in the art that the present invention is not limited by what has been particularly shown and described hereinabove. Rather the scope of the present invention extends to variations, combinations and subcombinations of the features described hereinabove.

I claim:

1. An electric shaver comprising:

an electric motor and a shaving head, driven by the electric motor, for cutting hair to be shaved, the shaving head including:

at least one cutting blade having a cutting edge;

at least one cutting plate defining a generally flat surface perpendicular to said cutting edge, the cutting edge touchingly engaging said flat surface upon cutting through a strand of hair.

2. An electric shaver according to claim 1 and wherein said at least one cutting blade comprises a pair of cutting blades which engage oppositely directed surfaces on said at least one cutting plate.

3. An electric shaver according to claim 2 and wherein a protective screen is not interposed between said at least one blade and a user's skin.

4. An electric shaver according to claim 2 and wherein said shaving head comprises at least two drive elements which are driven in reciprocating relative movement by the electric motor, said reciprocating relative movement having an amplitude which is greater than the amplitude of relative displacement of the cutting blades, whereby extra travel of the driving elements is taken up by the resiliency of the cutting blades.

5. An electric shaver according to claim 1 and also comprising skin tensioning elements for tensioning a portion of skin bearing a strand of hair to be shaved.

6. An electric shaver according to claim 5 and wherein a protective screen is not interposed between said at least one blade and a user's skin.

7. An electric shaver according to claim 5 and wherein said skin tensioning elements are selectably positionable relative to said at least one blade for enabling user selection of shave closeness.

8. An electric shaver according to claim 1 and wherein a protective screen is not interposed between said at least one blade and a user's skin.

9. An electric shaver according to claim 1 and wherein said at least one cutting plate defines a skin engagement edge surface which extends towards a user's skin beyond the location of said at least one cutting blade, thus preventing engagement of the at least one cutting edge with the user's skin.

10. An electric shaver according to claim 1 and wherein said at least one cutting blade is resilient.

11. An electric shaver according to claim 1 and comprising a plurality of cutting assemblies, each comprising one of said at least one cutting plate and two of said at least one blade.

12. An electric shaver according to claim 11 and comprising a cam drive, driven by said electric motor, which drives said plurality of cutting assemblies in hair cutting action.

13. An electric shaver according to claim 1 and further comprising a selector for selectably positioning said at least one cutting plate relative to said at least one blade.

14. An electric shaving method comprising:

employing an electric motor and a shaving head, driven by the electric motor, for cutting hair to be shaved, the shaving head operating by engagement of a cutting edge of at least one cutting blade with a generally flat surface of an cutting plate upon cutting through a strand of hair.

15. An electric shaving method according to claim 14 and wherein said shaving head operates by causing a pair of cutting blades which engage oppositely directed surfaces on said cutting plate.

16. An electric shaving method according to claim 15 and also comprising tensioning a portion of skin bearing a strand of hair to be shaved.

17. An electric shaving method according to claim 15 and wherein a protective screen is not interposed between said at least one blade and a user's skin.

18. An electric shaving method according to claim 15 and wherein said shaving head comprises at least two drive elements which are driven in reciprocating relative movement by the electric motor, said reciprocating relative movement having an amplitude which is greater than the amplitude of relative displacement of the cutting blades, whereby extra travel of the driving elements is taken up by the resiliency of the cutting blades.

19. An electric shaving method according to claim 14 and also comprising tensioning a portion of skin bearing a strand of hair to be shaved.

20. An electric shaving method according to claim 19 and wherein skin tensioning elements are selectably positionable relative to said at least one blade for enabling user selection of shave closeness.

21. An electric shaving method according to claim 14 and wherein a protective screen is not interposed between said at least one blade and a user's skin.

22. An electric shaving method according to claim 14 and wherein said at least one cutting plate provides a skin engagement edge surface which extends towards a user's skin beyond the location of said at least one cutting blade, thus preventing engagement of the cutting edge with the user's skin.

23. An electric shaving method according to claim 22 and wherein said electric motor drives said plurality of cutting assemblies via an cam drive.

24. An electric shaving method according to claim 14 and wherein reciprocating cutting action of said at least one cutting blade is produced at least in part by the resiliency of said at least one cutting blade.

25. An electric shaving method according to claim 14 and wherein said electric motor drives a plurality of cutting assemblies, each comprising an cutting plate and at least two blades.

26. An electric shaving method according to claim 14 and wherein said at least one cutting plate is selectably positioned relative to said at least one blade to effect user selection of shave closeness.

* * * * *